US010118379B2

(12) United States Patent
Brohard et al.

(10) Patent No.: US 10,118,379 B2
(45) Date of Patent: Nov. 6, 2018

(54) MULTI-FUNCTION HEAT FOIL EMBOSSING MACHINE

(71) Applicants: Earl Brohard, Cedar Hills, UT (US); Ji Yu Chen, Shanghai (CN)

(72) Inventors: Earl Brohard, Cedar Hills, UT (US); Ji Yu Chen, Shanghai (CN)

( * ) Notice: Subject to any disclaimer, the term of this patent is extended or adjusted under 35 U.S.C. 154(b) by 12 days.

(21) Appl. No.: 15/112,963

(22) PCT Filed: Jan. 21, 2015

(86) PCT No.: PCT/US2015/012174
§ 371 (c)(1),
(2) Date: Jul. 20, 2016

(87) PCT Pub. No.: WO2015/112549
PCT Pub. Date: Jul. 30, 2015

(65) Prior Publication Data

US 2017/0028704 A1 Feb. 2, 2017

Related U.S. Application Data

(60) Provisional application No. 61/965,081, filed on Jan. 22, 2014.

(51) Int. Cl.
*B31F 1/07* (2006.01)
*B44B 5/00* (2006.01)
(Continued)

(52) U.S. Cl.
CPC ..... *B41F 1/02* (2013.01); *B31F 1/07* (2013.01); *B41D 1/00* (2013.01); *B41D 1/06* (2013.01);
(Continued)

(58) Field of Classification Search
CPC .. B31F 1/07; B41F 19/02; B41F 19/06; B44B 5/0052; B44B 5/0085; B44B 5/022; B44B 5/026; B44B 5/028
(Continued)

(56) References Cited

U.S. PATENT DOCUMENTS 3,296,958 A * 1/1967 Liepelt ..... B41F 3/52 101/31
3,397,425 A 8/1968 Phillipson et al.
(Continued)

OTHER PUBLICATIONS

International Search Report and Written Opinion dated Apr. 10, 2015 for related PCT patent application No. PCT/US2015/012174.

*Primary Examiner* — Leslie J Evanisko
(74) *Attorney, Agent, or Firm* — D'Ambrosio & Menon, PLLC; Usha Menon

(57) ABSTRACT

A multi-purpose heat foil embossing machine and a heat foil adapter are disclosed herein. According to an embodiment the heat foil adapter includes an injection molded body, a metal heat plate configured in the cavity of the molded body, a heating element, a temperature control system configured to maintain metal heat plate temperature, and a polycarbonate lid. According to another embodiment, the multi-purpose heat foil embossing machine is of platform and roller type construction wherein platform provides a flatbed working area and roller is moved over it that eliminates need to sandwich folder between plastic mats and push the mat between the rollers. According to another embodiment, the heat plate adapter is configured within a cavity on the platform of the embossing machine with electric connectivity.

18 Claims, 8 Drawing Sheets

(51) Int. Cl.

| | |
|---|---|
| ***B41F 1/02*** | (2006.01) |
| ***B41D 1/00*** | (2006.01) |
| ***B44B 5/02*** | (2006.01) |
| ***B41F 19/02*** | (2006.01) |
| ***B44C 1/17*** | (2006.01) |
| ***B41D 1/06*** | (2006.01) |
| ***B41F 1/06*** | (2006.01) |
| ***B41F 1/38*** | (2006.01) |
| ***B41M 1/26*** | (2006.01) |
| ***B44C 1/24*** | (2006.01) |

(52) U.S. Cl.
CPC ..... *B41F 1/06* (2013.01); *B41F 1/38* (2013.01); *B41F 19/02* (2013.01); *B41M 1/26* (2013.01); *B44B 5/0052* (2013.01); *B44B 5/0085* (2013.01); *B44B 5/022* (2013.01); *B44B 5/028* (2013.01); *B44C 1/1729* (2013.01); *B44C 1/24* (2013.01)

(58) Field of Classification Search
USPC ..... 101/8, 9, 21, 27, 31, 28, 26
See application file for complete search history.

(56) References Cited

U.S. PATENT DOCUMENTS

| | | | | |
|---|---|---|---|---|
| 3,562,066 | A | 2/1971 | St. Denny | |
| 6,062,134 | A | 5/2000 | Eitel et al. | |
| 6,213,676 | B1 * | 4/2001 | Rebeaud | B41F 19/06 403/13 |
| 6,429,409 | B1 * | 8/2002 | Siu | A47J 37/0611 219/450.1 |
| 2004/0134287 | A1 | 7/2004 | Lin et al. | |
| 2006/0272511 | A1 * | 12/2006 | Dreimann | A47J 37/0611 99/372 |
| 2012/0192733 | A1 * | 8/2012 | Angevine | B44B 5/026 101/26 |
| 2014/0283697 | A1 | 9/2014 | Lu et al. | |

* cited by examiner

MULTI-FUNCTION HEAT FOIL EMBOSSING MACHINE

FIELD OF INVENTION

The present disclosure relates generally to a device for creating hot embossed or printed images.

BACKGROUND

The background description includes information that may be useful in understanding the present invention. It is not an admission that any of the information provided herein is prior art or relevant to the presently claimed invention, or that any publication specifically or implicitly referenced is prior art.

An embossing machine is device that is used to emboss, that is, produce raised designs on various media, such as, paper, thin metal foils, and other substrates that can be pressed. The embossing machine can additionally be used for die cutting various media by using a cutting die. The embossing machines are typically used to press two sides of an embossing folder or cutting die within which a desired medium, such as, cardstock paper is placed.

Existing embossing machines typically include two fixed position rollers between which an embossing folders or cutting die sandwiched between plastic mats is pushed. As one of the rollers is rotated, the sandwiched folder or stack moves between the rollers from one side to other with rollers pressing the sandwiched stack. During the process, the stack has to be held by hand to provide support and to guide it between the rollers and to also catch it as it comes out from other side of the rollers. These machines have a permanent opening through which the user pushes the stack. At times, the user may push an oversized stack causing the machine to jam damaging the project.

SUMMARY

There is a need for a novel embossing machine that is configured to carry out hot embossing in addition to other functions, and simultaneously overcome shortcomings of the existing embossing machines.

A novel embossing machine is provided to solve above-described limitations of conventional embossing machines. According to an embodiment, the embossing machine can include a heat plate adapter (also referred to as heat foiling adapter or as adapter and all terms used interchangeably hereinafter) that can be configured with a metal heat plate or heat plate. Further, the heat plate can incorporate a ribbon type heating element that receives a 24V power supply to heat up the metal heat plate.

According to another embodiment, there can be a temperature control system configured with heat plate adapter to maintain its temperature. In a preferred embodiment, the temperature control system can maintain the metal heat plate at 80° C. temperature.

According to another embodiment, the heat plate adaptor can include an injection molded body with a metal heat plate inserted into a cavity, wherein the electrical components and heating element(s) can be added underneath. The connection for power can be through a built-in plug-in connection configured on the embossing machine and the heat foiling adapter. Further, there can be a hinged polycarbonate lid configured with the heat plate adapter to close it. Alternately, the heat plate adapter may be provided with a separate or separable polycarbonate lid.

According to another embodiment, the embossing machine can include a platform and roller type assembly. In an aspect, the platform can provide a flatbed working area that can eliminate the need to sandwich folder between plastic mats and push the mat between the rollers. The heat plate adapter can be configured within a cavity on the platform and can draw a power supply, such as 24V power supply, through a connection with the machine. A heat plate die, along with foil piece, and desired material or media (to be foiled) such as paper, fabric, wood, plastic, leather, polyurethane material can be placed on the heat plate, and the polycarbonate lid can be closed. In alternate applications, an embossing folder or a cutting die along with media can be placed between the adapter and the lid. Thereafter, the embossing machine roller can apply enough pressure over the lid to transfer the foil color by heat to the material selected or emboss the desired pattern or cut desired shape. In an aspect, the adapter along with die, media etc. remains stationary on the platform and the roller can run over the sandwich stack to apply sufficient pressure to carry out various functions such as embossing, die cutting, or hot embossing. In another aspect, there is no need to hold the sandwich stack to guide and support it and catch it as it exits the rollers from other side thereby providing an easier and more comfortable process.

According to another embodiment, the embossing machine can include a platform, supporting body, rollers and a gear or gearing assembly. The gearing assembly and rollers can be mounted on the supporting body to provide them mobility in relation with the platform. There can be two rollers, a top roller that can move across the top surface of the platform, and a bottom roller that can be connected to the gearing assembly and track system. The bottom roller can include at least two gears. A first gear is located at a first end of the bottom roller and the second gear is located at a second end of the bottom roller. The gears can drive the rollers and support the body across the platform. The two gears can engage with toothed tracks embedded on the platform.

According to another embodiment, the embossing machine can incorporate a mechanism to adjust the gap between the platform and the top roller according to requirement. As a person skilled in art will understand and know, the sandwich stack may vary in thickness depending on the type of media, the embossing folder/cutting or foiling die, and other factors/parameters. Variation in stack thickness can typically be compensated by the plastic mats added to the stack before the stack is pushed between the rollers. In an aspect, a feature to adjust gap between roller and platform can help user to streamline and speed up the process.

According to another embodiment, the heat plate adapter can also be configured for use with any of the existing embossing machines. Power input jack can be molded at end of the adapter and plugged to any suitable power source for heating. The power connection can be unplugged as the heat adapter plate goes through the roller opening of a conventional embossing machine. In another aspect, the adapter can be made in different sizes to suite conventional embossing machines of varying sizes already in use with millions of users.

Various objects, features, aspects and advantages of the inventive subject matter will become more apparent from the following detailed description of preferred embodiments, along with the accompanying drawing figures in which like numerals represent like components.

DETAILED DESCRIPTION

Figure 1:
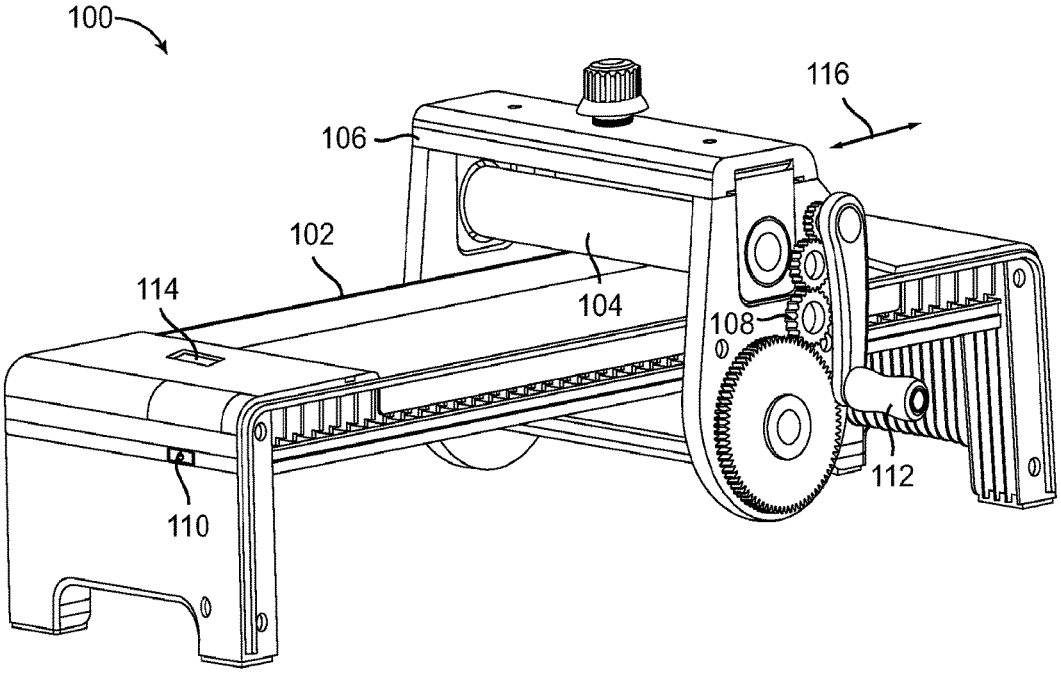
FIG. 1 illustrates an exemplary perspective view of a multi-purpose heat foil embossing machine in accordance with an embodiment.

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the present disclosure as defined by the appended claims.

Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Various terms are used herein. To the extent a term used in a claim is not defined below, it should be given the broadest definition persons in the pertinent art have given that term as reflected in printed publications and issued patents at the time of filing.

Conventional embossing machines for craft and hobby enthusiasts do not incorporate features to carry out hot embossing such as heat foiling function that is often required for embossing media such as leather, faux leather, wood, paper, plastic etc. Most heat foiling machines are standalone machines of industrial size requiring dies that are expensive and specific to large quantities and therefore not suitable for crafters, hobby enthusiasts, card makers and home décor specialists and teachers to use as an easy method of foiling.

In the absence of suitable means, a hot embossing die has to be heated separately and thereafter passed between the rollers after placing foil and media between them. In this method, it is difficult to maintain embossing temperature and temperature variation may not give consistent results and may even result in spoiling the project. Accordingly, there is a need for a heat foil embossing machine that can overcome the limitations of conventional embossing machines.

Referring now to FIG. 1, an exemplary isometric view of a multi-purpose heat foil embossing machine 100 is disclosed in accordance with the various embodiments herein. The multi-purpose heat foil embossing machine 100 can be of platform and roller type construction and can include a platform 102, roller 104, supporting body 106, and a gearing assembly 108. The gearing assembly 108 and roller 104 can be mounted on the supporting body 106 to provide them mobility in relation to the platform 102. In an aspect, platform 102 can provide a flatbed working area on which a folder (not shown), such as, an embossing or a cutting die (or dye) or a heat foiling die, can be placed and a roller 104 moved over the folder as shown by arrows 116 by rotation of a handle 112. Advantageously, the flatbed construction can eliminate a need to sandwich the folder between plastic mats and to push the mat between the rollers by hand and to hold it as it exits from the rollers at the other end. Therefore, the flatbed construction provides an easier and more comfortable process for embossing.

Figure 2A:
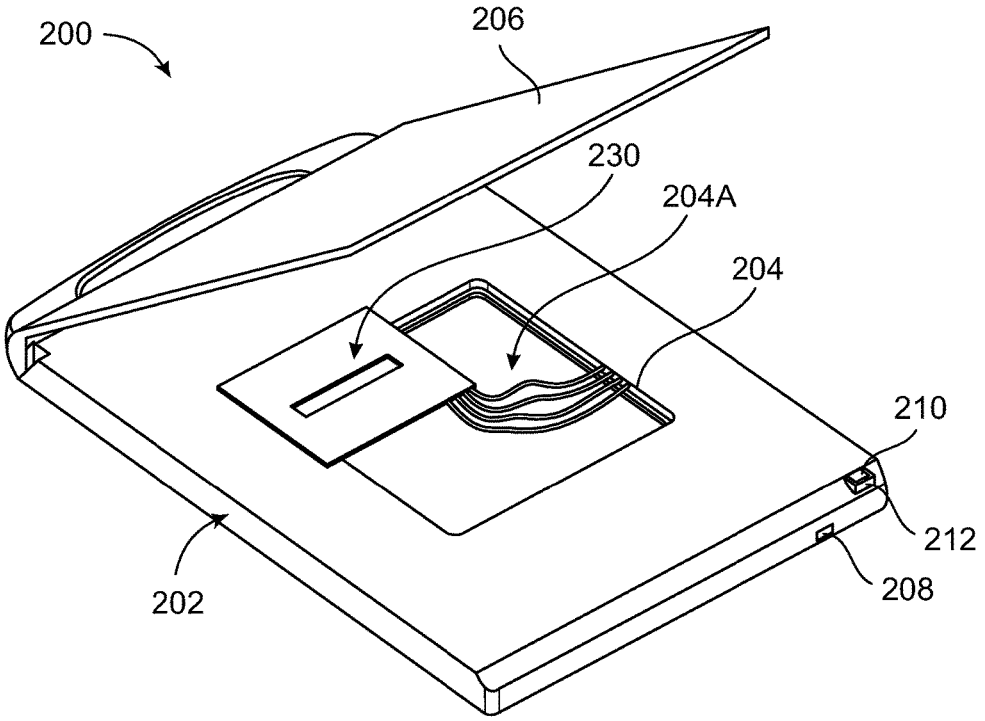
FIG. 2A illustrates an exemplary isometric view of a heat foil adapter in accordance with an embodiment.

Now referring to FIG. 1 and FIG. 2A, in another embodiment, the multi-purpose heat foil embossing machine 100 can incorporate a heat plate adapter 200 on its platform. The adapter 200 can be inserted in a cavity on the platform 102 and removed when required. The adapter 200 can be configured with a metal heat plate and a ribbon type heating element that can be powered by a 24V DC adapter and electrically connected to the machine 100 to draw power for heating. The machine 100 can incorporate a switch 110 to control power flow. The power switch 110 to start or discontinue the heating of heat foiling die. The power supply status to the heat foiling die can be indicated by a suitable indicator 114. For instance, the indicator 114 may be a power light. The power light 114 can have two light emitting diodes (LEDs) of different colors such as red and green, red indicating the power ON status and green indicating status of temperature. The light indicating status of temperature can get ON when the adapter 200 reaches the desired temperature and is ready for use. It is understood that the power light 114 may be configured with other colored LEDs.

FIG. 2A illustrates an exemplary isometric view of the heat plate adapter 200 in accordance with an embodiment. The heat plate adapter 200 can incorporate an injection molded body 202 (also referred to simply as body 202 hereinafter). The injection molded body 202 can have a cavity (204A) to accommodate a metal heat plate 204 (also referred to as heat plate 204 hereinafter). Heat plate 204 can be made of a heat conducting material, such as, aluminium. The shape of heat plate 204 can match the shape of the cavity and the depth of the cavity can be such that after the heat plate 204 has been inserted therein, the heat plate 204 can be configured at the same level or flush with the top surface of the body 202 without any gaps. The heat plate 204 (and corresponding cavity) can have any shape such as round, oval polygon or rectangular without any limitation. In the exemplary embodiment, shown in FIG. 2A, it is shown to be of rectangular shape.

According to another embodiment, there can be a temperature control system (235) configured with the heat plate adapter 200 to maintain its temperature. In a preferred embodiment, the temperature control system can maintain metal heat plate at or around 80° C. temperature.

Referring again to FIG. 1 and FIG. 2A, in an embodiment, electrical components and one or more heating elements (not shown) can be added underneath the heat plate 204. The connection for power can be through a built-in plug-in connection configured on the embossing machine 100 and the heat plate adapter 200. Further, a hinged polycarbonate lid 206 (also referred to as simply lid 206 hereinafter) can be configured with the body 202 to close the adapter 200, wherein the hinge (not shown) may be of such configuration such that, if required, the polycarbonate lid 206 and the body 202 can be separated from each other. The hinge can further allow accommodating a stack of material between the body 202 and the lid 206 and allowing them to move laterally so that the hinge does not get unnecessarily loaded when the lid 206 is pressed by the roller 104 of the multi-purpose heat foil embossing machine 100.

In one application, a heat plate die (not shown), configured with a design to be foiled, along with a foil piece, media to be foiled, such as paper, fabric, wood, plastic, leather, polyurethane material, etc., can be placed on the heat plate 204 and the polycarbonate lid 206 may be closed. In an alternate application, an embossing folder or a cutting die along with the media can be placed between the heat plate adapter 200 and the polycarbonate lid 206. Thereafter, the roller 104 can apply enough pressure over the lid to transfer the foil color by heat to the material selected or emboss the desired pattern or cut a desired shape. The heat plate adapter 200 along with the die, media etc. remains stationary on the platform and the roller 104 can run over the sandwiched stack to apply sufficient pressure to carry out various functions, as needed, such as, embossing, die cutting or hot embossing.

Referring back to FIG. 2A, in another embodiment, the heat plate adapter 200 can be configured for use with any of the existing or conventional embossing machines. Power input jack 208 can be molded at end of the body 202 and it may be plugged to any suitable power source for heating. The heat plate adapter 200 can incorporate a power status indicator 210 and a temperature indicator 212, wherein the power connection can be unplugged as the heat adapter plate 200 goes through the roller opening of a conventional embossing machine. In another aspect, the heat plate adapter 200 can be made in different sizes to suite conventional embossing machines of varying sizes already in use.

Figure 2B:
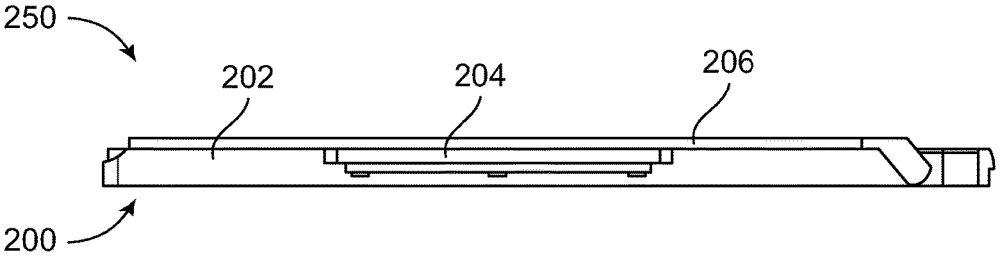
FIG. 2B illustrates a side view of the heat foil adapter illustrated in FIG. 2A.
Figure 2C:
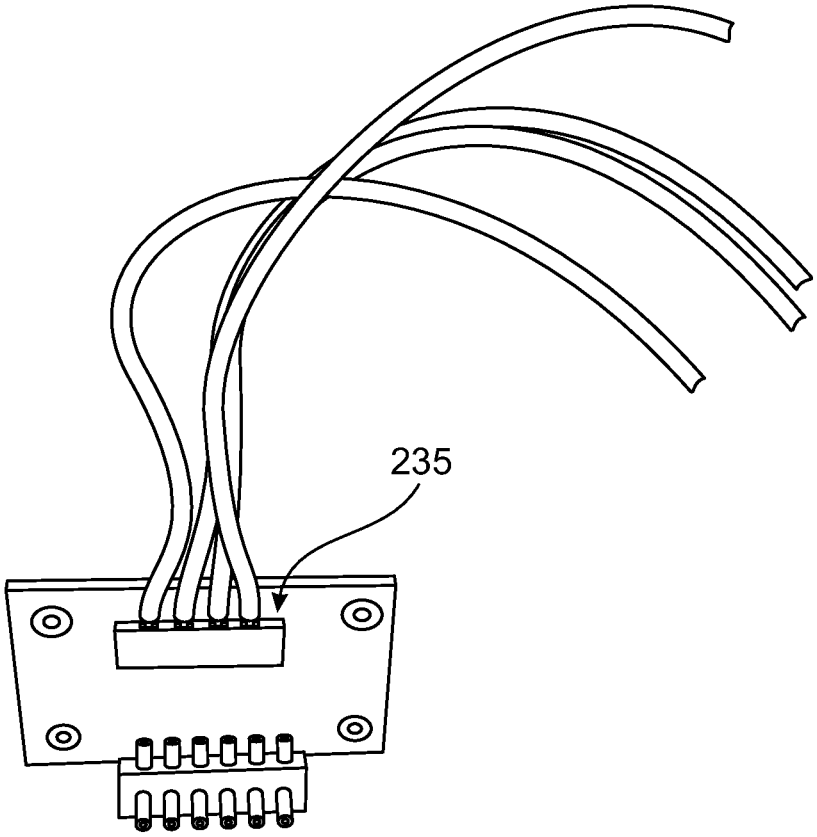
FIG. 2C illustrates a perspective view of the temperature control system in accordance with an embodiment

FIG. 2B illustrates an exemplary side view 250 of the heat plate adapter 200. As depicted, heat plate adapter 200 can incorporate an injection molded body 202 with a cavity 204A within which a metal heat plate 204 can be inserted. As shown, the cavity is sized and has depth such that the heat plate 204 sits there without any projection above the top surface of the body 202 and gap. A heating element (not shown) can be accommodated underneath the heat plate 204. The heat plate adapter 200 can also incorporate a polycarbonate lid 206 that can be hinged at an interface side.

Figure 3:
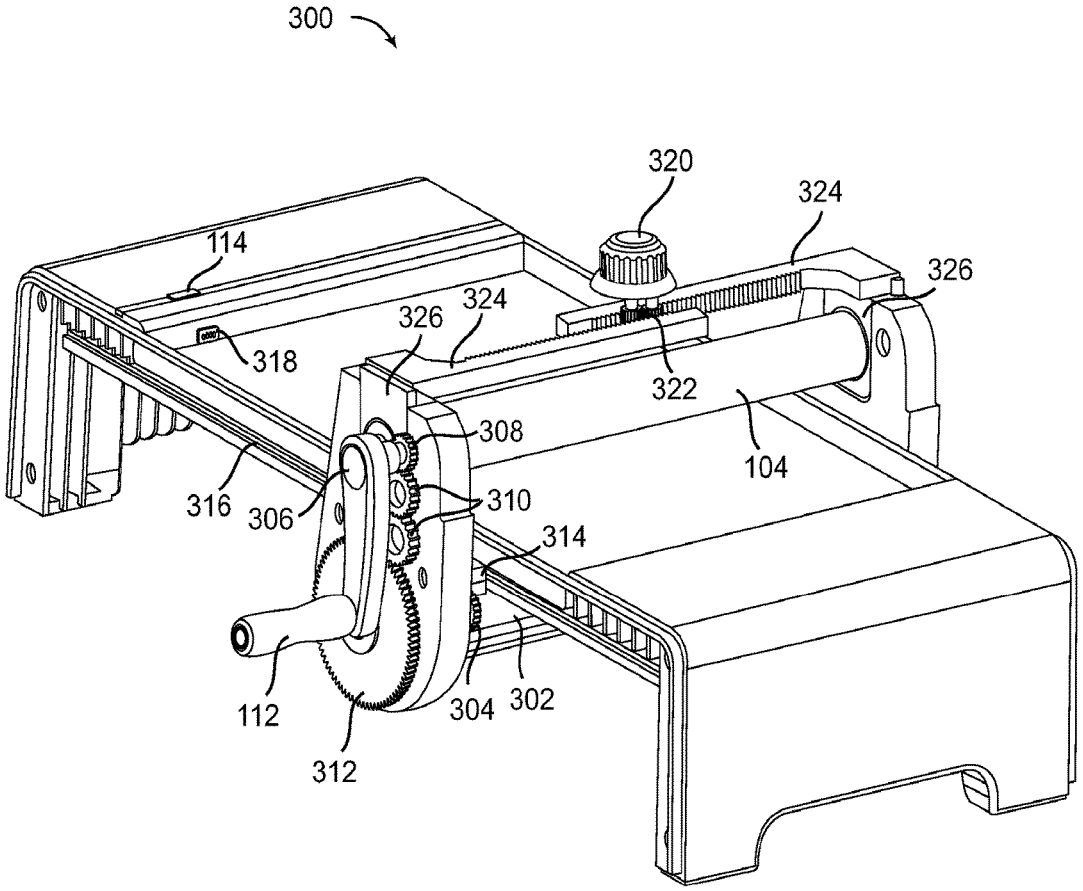
FIG. 3 illustrates another perspective view of the multi-purpose heat foil embossing machine illustrated in FIG. 1 in accordance with an embodiment.

FIG. 3 illustrates another perspective view 300 of the multi-purpose heat foil embossing machine 100 illustrated in FIG. 1, wherein further constructional details of the embossing machine 100 have been shown. According to another embodiment, besides the platform 102 and roller 104 (hereinafter called a "top roller" to distinguish it from a "bottom roller"), supporting body 106 and gearing assembly 108, can include a bottom roller 302. While the top roller 104 can move across the top surface of the platform 102, the bottom roller 302 can be connected to the gearing assembly 108 and run below the platform to allow the supporting body 106 to move across the platform 102. The bottom roller 302 can have two gears 304, one at each end, that can engage with a toothed rack (not shown) embedded on the bottom of the platform 102. The bottom roller 302 can be connected to crank shaft 306 and handle 112 through a driving gear 308, two transition gears 310 and a passive gear 312 that form part of the gearing assembly 108. In an aspect, the exemplary embossing machine 100 is manual, wherein the top roller 104 is moved over the platform 102 by manual rotation of the handle 112. As persons skilled in art would understand, it is possible to provide for mechanized movement, wherein an electric motor can drive the embossing machine 300 to move the top roller 104 over the platform 102.

The multi-purpose heat foil embossing machine 300 can further include two stabilizer brackets 314 attached on either side of the bottom roller 302. Each stabilizer bracket 314 can have a metal wheel (not shown here) attached that can travel in a grooved channel 316 and can help in maintaining the level of top roller 104 in relation with platform 102.

Now referring to both FIG. 2A and FIG. 3, the multi-purpose heat foil embossing machine 300 can further include a jack 318 to which power input jack 208 of the heat plate adapter 200 can be connected when the heat plate adapter 200 is placed on platform 102 and electrically connect the heat plate adapter 200 to the multi-purpose heat foil embossing machine 300 for drawing power for heating the heat plate 204. As stated earlier, a power switch (110, shown in FIG. 1) can be used to start or discontinue the heating of heat foiling die. The power supply status to the heat plate adapter 200 and temperature status of the heat plate adapter 200 can be indicated by one or more LEDs of different colors configured on the power light 114.

The multi-purpose heat foil embossing machine 300 can further include a novel mechanism to adjust the distance between platform 102 and top roller 104. The mechanism can include a height adjusting knob 320 (also referred to as adjusting knob or knob hereinafter), a locking feature 322, horizontal driving shafts 324, and vertical sliding spring posts 326. The distance between the top roller 104 and the platform 102 can be increased or decreased by rotation of the height adjusting knob 320 in one or another direction. For convenience, the height adjusting knob 320 may be provided with indicators, such as, markings, to indicate the direction of rotation for increasing the distance and reducing the distance between top roller 104 and platform 102.

When the height adjusting knob 320 is rotated, the horizontal driving shafts 324 can move inwards or outwards. The horizontal driving shafts 324 are engaged to vertical sliding spring posts 326 through wedge shaped slants (not shown) that can make the vertical sliding spring posts 326 to move up or down as the horizontal driving shafts 324 move inwards or outwards. The outward movement of the two horizontal driving shafts 324 can cause the slants to push the two vertical sliding spring posts 326 down against a spring force. On the other hand, inward movement of the two horizontal driving shafts 324 can cause the slants to release the two vertical sliding spring posts 326 to allow them to move up under the force of springs. Two ends of the top roller 104 can be secured to the two vertical sliding spring posts 326 such that the top roller can move up and down along with the vertical sliding spring posts 326. More details of the mechanism are explained against FIG. 5, FIG. 7A and FIG. 7B in succeeding paragraphs.

Figure 4:
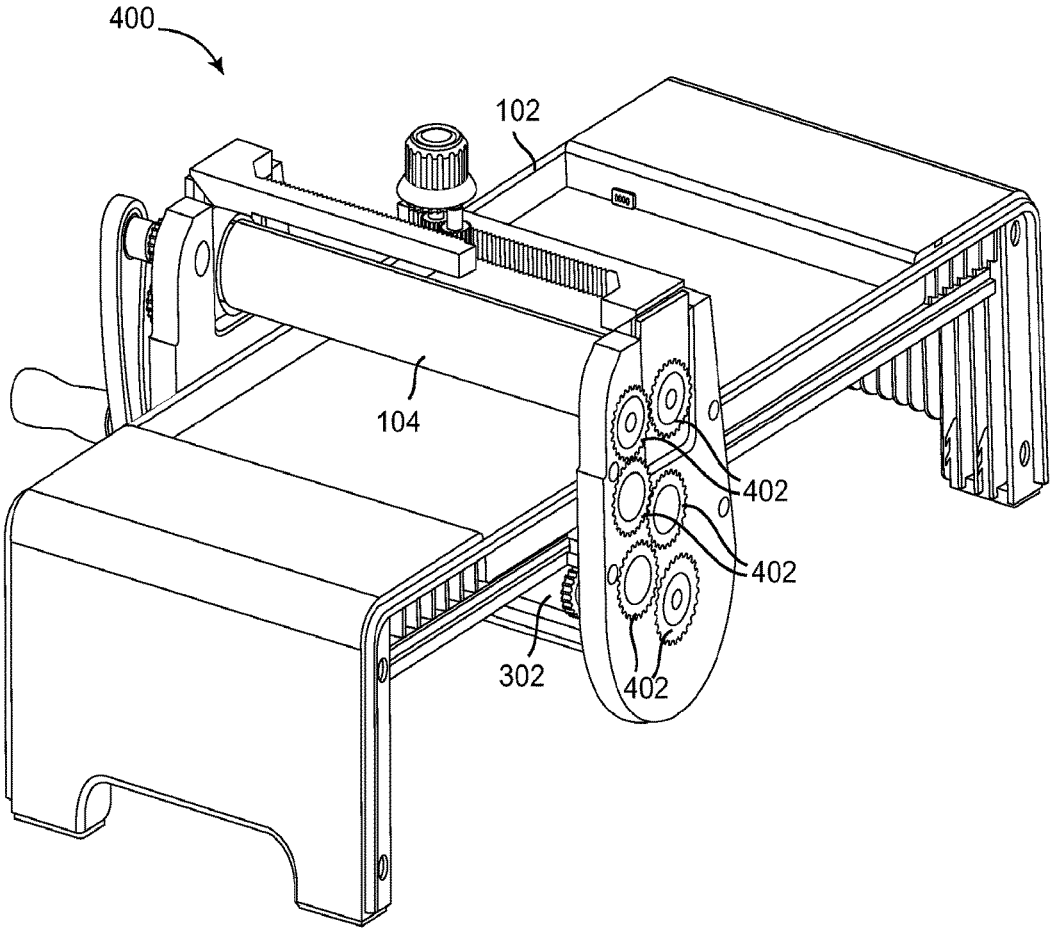
FIG. 4 illustrates a perspective view from left side of the multi-purpose heat foil embossing machine illustrated in FIG. 1 in accordance with an embodiment.

FIG. 4 illustrates a perspective view from a left side of the multi-purpose heat foil embossing machine 400 in accordance with an embodiment wherein the gearing arrangement that drives the top roller has been shown. The gears 402 can connect top roller 104 to bottom roller 302. The gears 402 can be configured to provide rotational motion to top roller 104 while at the same time giving it freedom to move up and down as distance between top roller 104 and platform 102 is adjusted.

Figure 5:
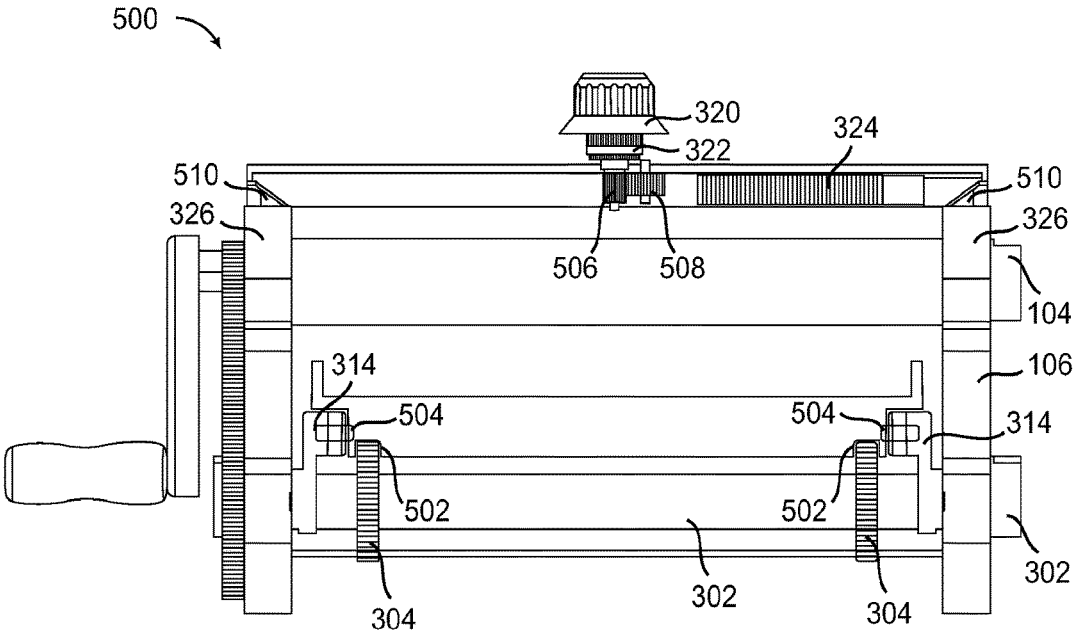
FIG. 5 illustrates an end view of the multi-purpose heat foil embossing machine illustrated in FIG. 1 in accordance with an embodiment.

FIG. 5 illustrates an end view of the multi-purpose heat foil embossing machine 500 in accordance with an embodiment wherein a track system that drives the supporting body 106 move across the platform 102. The bottom roller 302 can have two gears 304, one at each end, that can engage with a toothed rack 502 embedded on the bottom of the working platform 102. Also shown are two stabilizer brackets 314 attached on either side of the bottom roller 302. Each stabilizer bracket 314 can have a metal wheel 504 attached that can travel in a grooved channel 316 and can help in maintaining the level of top roller 104 in relation with platform 102.

Further shown in FIG. 5 are more details of the mechanism to adjust distance between platform 102 and top roller 104. The height adjusting knob 320 can be connected to a driving shaft gear 506. As the height adjusting knob 320 is turned, the driving shaft gear 506 makes gear 508 turn, wherein the gear 508 can be in engagement with teeth on the horizontal driving shafts 324 such that when the gear 508 turns the two horizontal driving shafts 324 move outward or inward depending on direction of rotation of height adjusting knob 320. Also shown are details of wedge shaped slants 510 on two ends of the horizontal driving shafts 324 and on upper ends of the two vertical sliding spring posts 326 that engage with each other to convert outwards or inwards movement of two horizontal driving shafts 324 to downwards or upwards movement of the vertical sliding spring posts 326.

Figure 6:
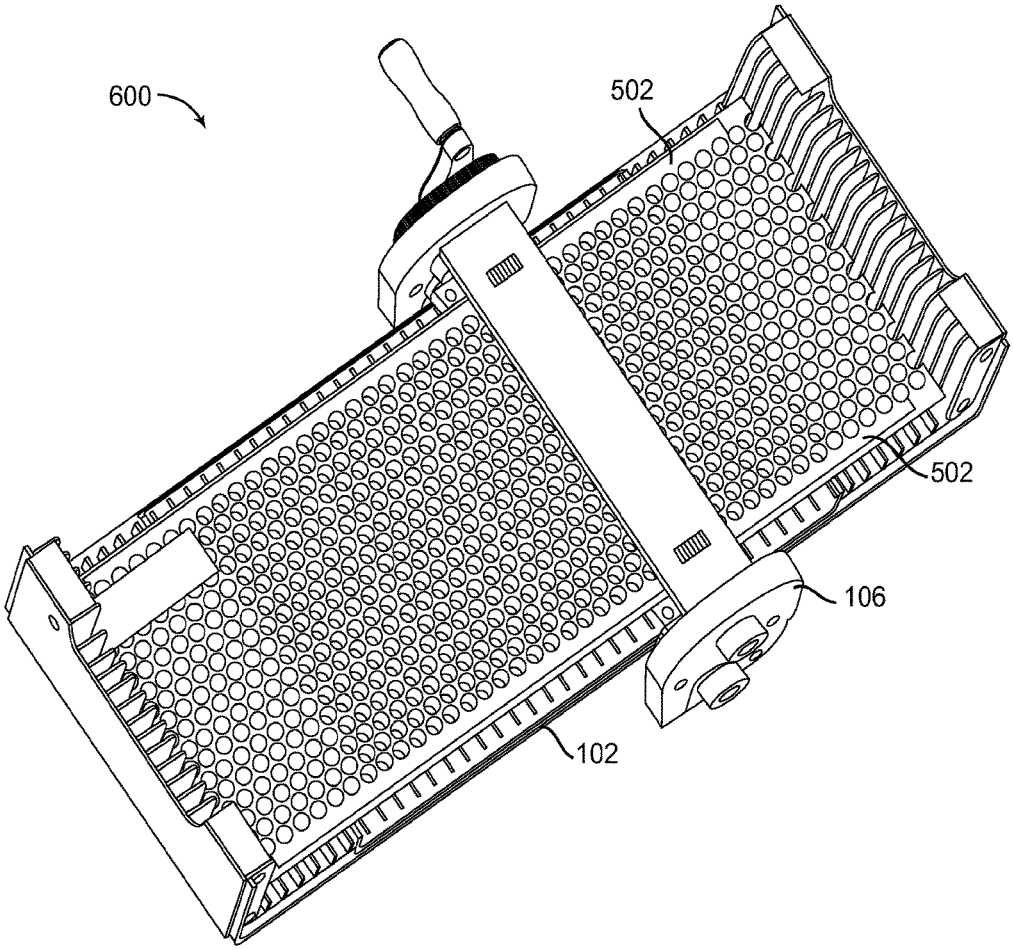
FIG. 6 illustrates an exemplary bottom view of platform showing supporting body, bottom roller and toothed in accordance with an embodiment.

FIG. 6 illustrates an exemplary bottom view of platform 600 wherein a toothed rack 502 has been shown in accordance with an embodiment. The two gears 304 configured on bottom roller 302, as shown in FIG. 5, can engage with the toothed rack 502 to drive the supporting body 106 along the platform 102.

Figure 7A:
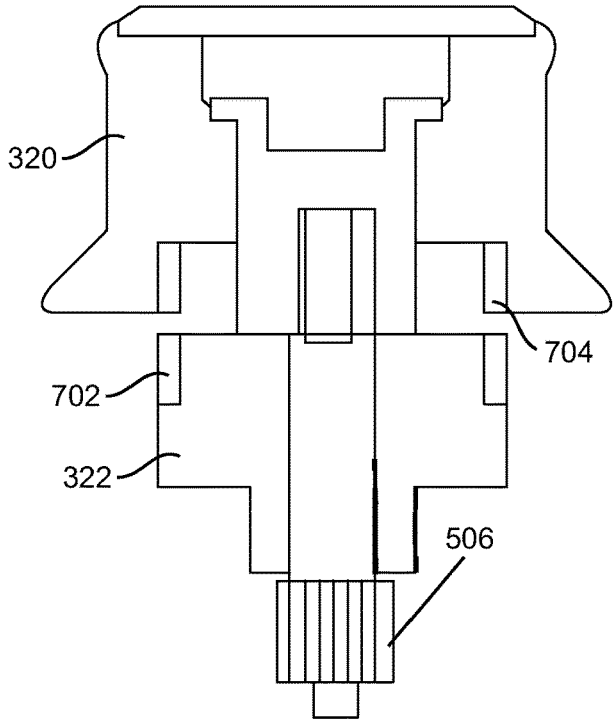
FIG. 7A and FIG. 7B illustrate an exemplary roller height adjusting arrangement in accordance with an embodiment.
Figure 7B:
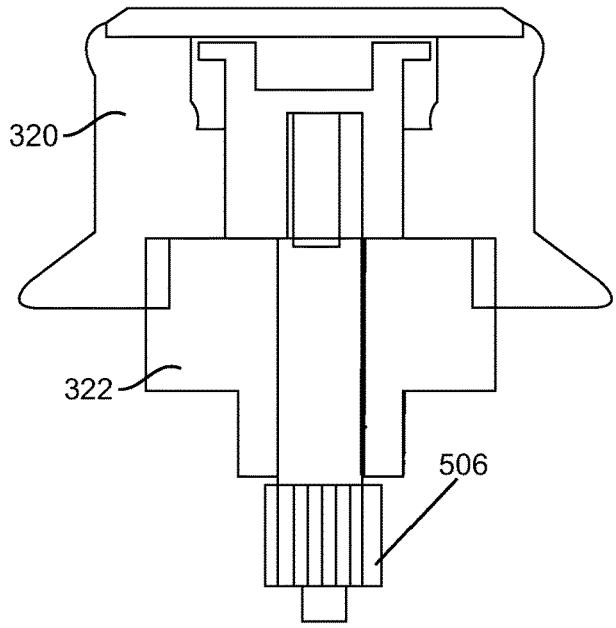

FIG. 7A and FIG. 7B illustrate arrangements of the height adjusting knob 320 and the locking feature 322 of the roller height adjusting arrangement in accordance with an embodiment. The locking feature 322 can be fastened to top of supporting body 106 and can incorporate notches 702 that can engage two keys 704 configured on the adjusting knob 320 thereby locking the height adjusting knob 320 to prevent its rotation. Pulling the adjusting knob 320 up can disengage the two keys 704 from notches 702 to make the adjusting knob 320 free for rotation as shown in FIG. 7A. After the adjusting knob 320 has been rotated to adjust the height, it can be pushed down to re-engage with the locking feature 322 to lock the adjusting knob 320 in its position as shown in FIG. 7B.

According to another embodiment, a method for embossing a folder involves providing the multi-purpose heat foil embossing machine described according to the one or more embodiments herein. The method involves adjusting the gap/distance between the top roller and the platform by turning or rotating the height adjusting knob. In an aspect, the distance can depend on total height of the heat plate adapter after an embossing folder has been placed therein and the lid of the heat plate adapter is closed. The embossing folder may include a material to be embossed, such as, card stock, faux leather, chipboard, plastic, fabric, etc. The adjustment may require an initial or trial adjustment with a substantially larger distance between the two and then incrementally or gradually reducing the distance until the top roller just touches the lid of the heat plate adapter. Thereafter, the distance/gap can be further reduced by a predetermined amount so as to cause a sufficient pressure on the embossing folder placed on the heat plate adapter. The predetermined amount can depend on the nature of work, type of folder, etc. and a person skilled in the art shall be well versed in this aspect. The method further includes placing the embossing folder with the card stock, for instance, placed within it on the heat plate adapter and subsequently closing its lid. The roller is then passed over the closed heat plate adapter. This causes the card stock to be embossed. The heat plate adapter is opened and the embossing folder is removed. The completed embossed card stock is removed from the embossing folder.

According to another embodiment, a method for die-cutting involves providing the multi-purpose heat foil embossing machine disclosed herein in accordance with an embodiment disclosed herein. As in the case of embossing, the method may involve adjusting the gap/distance between the top roller and the platform using the adjusting knob. The method further involves placing a cutting pad on the heat plate adapter after opening its lid. Thereafter, imprinted paper can be placed on the cutting pad followed by placing the die upon the paper. The roller can be moved over the stack after closing the lid of the heat plate adapter to complete the die cutting. The die cut mater can be removed after opening the lid.

According to another embodiment, a method for letter pressing with aluminium dies or acid etched dies involves providing the multi-purpose heat foil embossing machine in accordance with an embodiment disclosed herein. As described above, the method involves adjusting the gap/distance between the top roller and the platform using the adjusting knob. The plate can be properly positioned on the heat plate adapter after opening its lid. Thereafter, a color stamping ink can be applied on the plate followed by covering the plate with an appropriate card stock. The method further involves moving the roller over the stack after closing the lid of the heat plate adapter to complete the letter press art work which can be removed after opening the lid.

According to yet another embodiment, a method for hot stamping involves providing the multi-purpose heat foil embossing machine in accordance with an embodiment disclosed herein. As disclosed earlier, the method involves adjusting the gap/distance between the top roller and the platform using the adjusting knob. The method further includes connecting a 24V AC (or the like) adapter into a suitable power outlet, and switching on the power switch. As such, the power light shall turn "ON" to indicate a power ON status. The user can then wait for the green (or predetermined) light to be turned on, which shall indicate that the heat plate has attained the desired temperature and is now ready for hot stamping. The hot stamping plate can be then positioned in an appropriate position on the heat plate after opening lid of the heat plate adapter. The user can wait for a predetermined time (for instance, about one minute) for the stamping plate to reach a desired temperature. The stamping plate can be covered with hot stamping foil and a selected material, such as, card stock, faux leather, chipboard, plastic, fabric, etc. Thereafter, the lid of the heat plate adapter can be closed and the roller moved over for the die to press the plate to transfer the image. Thereafter, the lid can be opened to remove the hot stamped material.

Thus, the multi-purpose heat foil embossing machine disclosed herein can be used for embossing, letter pressing, die cutting, hot stamping etc. and can be useful in crafting and scrapbooking. Furthermore, the disclosed heat plate adapter of the present disclosure can be used with conventional stationary roller type embossing machines that are available in large numbers with craft and hobby enthusiasts world over.

The disclosed embodiments may be implemented within the same embossing folder or within separate embossing folders to support the various techniques described in this disclosure. Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

While the foregoing describes various embodiments of the invention, other and further embodiments of the invention may be devised without departing from the basic scope thereof. The scope of the invention is determined by the claims that follow. The invention is not limited to the described embodiments, versions or examples, which are included to enable a person having ordinary skill in the art to make and use the invention when combined with information and knowledge available to the person having ordinary skill in the art.

We claim:

1. A heat foil embossing machine comprising:

a heat plate adapter, wherein the heat plate adapter comprises:

a molded body having a cavity;

a heat plate inserted within the cavity of the molded body; and one or more heating elements configured within the cavity of the molded body; and a platform having a cavity, wherein the platform cavity is dimensioned to receive the heat plate adapter.

2. The heat foil embossing machine according to claim 1, further comprising:

a supporting body, the supporting body comprising:

a top roller;

a gearing assembly; and a bottom roller connected to the gearing assembly, wherein the gearing assembly and the bottom roller provide mobility to the supporting body in relation to the platform.

3. The heat foil embossing machine according to claim 2, further comprising an adjustment mechanism to adjust a gap between the top roller and the platform.

4. The heat foil embossing machine according to claim 2, wherein the gearing assembly comprises two gears, wherein a first gear is located at a first end of the bottom roller and wherein a second gear is located at a second end of the bottom roller.

5. The heat foil embossing machine according to claim 4, wherein the two gears engage with a toothed rack embedded on the bottom of the platform to allow the supporting body to move across the platform.

6. The heat foil embossing machine according to claim 5, wherein the movement of the supporting body across the platform is by means of manual operation of a handle.

7. The heat foil embossing machine according to claim 2, further comprising two stabilizer brackets attached on either side of the bottom roller.

8. The heat foil embossing machine according to claim 7, wherein each of the two stabilizer brackets comprise a metal wheel that travels in a groove channel to maintain a level of the top roller in relation with the platform.

9. The heat foil embossing machine according to claim 2, wherein the platform is operatively coupled with the supporting body.

10. The heat foil embossing machine according to claim 1, further comprising a switch to start or discontinue heating of the heat plate adapter.

11. The heat foil embossing machine according to claim 1, further comprising an indicator to indicate a power supply status to the heat plate adapter.

12. The heat foil embossing machine according to claim 1, wherein the heat plate adapter further comprises a temperature control system for maintaining the temperature of the heat plate at a defined temperature.

13. The heat foil embossing machine according to claim 1, wherein the heat plate is level with a top surface of the molded body.

14. The heat foil embossing machine according to claim 1, wherein the heat plate adapter further comprises a hinged lid, and wherein the hinged lid comprises a polycarbonate lid.

15. The heat foil embossing machine according to claim 1, wherein the heat plate adapter further comprises a separate or separable polycarbonate lid.

16. The heat foil embossing machine according to claim 1, wherein the heat plate adapter is operatively coupled with the platform having the cavity, wherein the heat plate adapter is configured within the cavity of the platform, and wherein the heat plate adapter is configured to be electrically coupled to the embossing machine.

17. A method for heat foil embossing comprising:

placing a foiling die configured with a media and a foil within the heat foil embossing machine according to claim 2;

adjusting a gap between the platform and the top roller of the heat foil embossing machine; and running the top roller over the heat plate adapter for hot stamping of the media with foil.

18. The method of claim 17, wherein the method is further used for embossing and die cutting.

* * * * *